US012760467B2

(12) United States Patent
Lee et al.

(10) Patent No.: US 12,760,467 B2
(45) Date of Patent: Oct. 13, 2026

(54) LAUNDRY TREATING APPARATUS AND METHOD FOR CONTROLLING THE LAUNDRY TREATING APPARATUS

(71) Applicant: LG Electronics Inc., Seoul (KR)

(72) Inventors: Haewoong Lee, Seoul (KR); Bio Park, Seoul (KR); Byeongjo Ryoo, Seoul (KR)

(73) Assignee: LG Electronics Inc., Seoul (KR)

( * ) Notice: Subject to any disclaimer, the term of this patent is extended or adjusted under 35 U.S.C. 154(b) by 1118 days.

(21) Appl. No.: 17/776,104

(22) PCT Filed: Dec. 16, 2020

(86) PCT No.: PCT/KR2020/018403
§ 371 (c)(1),
(2) Date: May 11, 2022

(87) PCT Pub. No.: WO2021/125770
PCT Pub. Date: Jun. 24, 2021

(65) Prior Publication Data

US 2022/0389647 A1 Dec. 8, 2022

(30) Foreign Application Priority Data

Dec. 17, 2019 (KR) ..... 10-2019-0169253

(51) Int. Cl.
*D06F 58/45* (2020.01)
*D06F 34/28* (2020.01)
(Continued)

(52) U.S. Cl.
CPC ..... *D06F 58/45* (2020.02); *D06F 34/28* (2020.02); *D06F 58/206* (2013.01); *D06F 58/22* (2013.01);
(Continued)

(58) Field of Classification Search
CPC ..... D06F 58/45; D06F 34/28; D06F 58/206; D06F 58/22; D06F 58/24; D06F 2103/08;
(Continued)

(56) References Cited

U.S. PATENT DOCUMENTS

2010/0146809 A1* 6/2010 Grunert ..... D06F 58/45 34/88
2013/0091726 A1 4/2013 Kim et al.
(Continued)

FOREIGN PATENT DOCUMENTS

CN 103547728 1/2014
CN 104919105 9/2015
(Continued)

OTHER PUBLICATIONS

Extended European Search Report in European Appln. No. 20902518.8, mailed on Nov. 6, 2023, 9 pages.
(Continued)

*Primary Examiner* — Jessica Yuen
(74) *Attorney, Agent, or Firm* — Fish & Richardson P.C.

(57) ABSTRACT

Disclosed is a laundry treating apparatus including: a cabinet having a laundry inlet and a filter insertion hole defined in a front face thereof; a drum rotatably disposed inside the cabinet and having a laundry storage space defined therein communicating with the laundry inlet; a duct disposed inside the cabinet, wherein the duct defines a channel for supplying air discharged from the drum back to the drum; a fan to move air along the duct; a heat exchanger including a heat-absorber to remove moisture from air introduced into the duct and a heat-emitter disposed inside the duct to heat air passing through the heat-absorber; a water collector constructed to communicate with the duct and to store therein water discharged from the water passing through the heat-absorber; a filter assembly including: a filter assembly
(Continued)

body attachable to or detachable from the duct and constructed to be extended from or retractable into the cabinet through the filter insertion hole; a first filter disposed in the filter assembly body to filter fluid moving to the heat-absorber; and a second filter disposed in the filter assembly body to filter fluid moving to the water collector, wherein the second filter is positioned below the first filter; a water discharger detachably disposed in the cabinet and having a water storage space defined therein; a water discharger supply pipe for supplying water stored in the water collector to the water discharger; a water ejector configured to eject water into the first filter; and a water ejector supply pipe for supplying water stored in the water collector to the water ejector. Further, a method for controlling the apparatus is disclosed.

13 Claims, 5 Drawing Sheets

(51) Int. Cl.

| | |
|---|---|
| ***D06F 58/20*** | (2006.01) |
| ***D06F 58/22*** | (2006.01) |
| ***D06F 58/24*** | (2006.01) |
| ***D06F 103/08*** | (2020.01) |
| ***D06F 103/32*** | (2020.01) |
| ***D06F 103/58*** | (2020.01) |
| ***D06F 105/02*** | (2020.01) |

(52) U.S. Cl.
CPC ..... *D06F 58/24* (2013.01); *D06F 2103/08* (2020.02); *D06F 2103/32* (2020.02); *D06F 2103/58* (2020.02); *D06F 2105/02* (2020.02)

(58) Field of Classification Search
CPC ..... D06F 2103/32; D06F 2103/58; D06F 2105/02; D06F 25/00; D06F 2103/18; D06F 2105/34; D06F 33/30; D06F 58/263; D06F 58/30; D06F 58/38; B01D 46/0086; B01D 46/44; B01D 46/681
See application file for complete search history.

(56) References Cited

U.S. PATENT DOCUMENTS

| | | | |
|---|---|---|---|
| 2016/0076192 | A1 | 3/2016 | Pos et al. |
| 2016/0145793 | A1 | 5/2016 | Ryoo et al. |
| 2016/0376744 | A1 | 12/2016 | Lv et al. |
| 2018/0171537 | A1 | 6/2018 | Lee et al. |
| 2019/0330790 | A1 | 10/2019 | Ko et al. |

FOREIGN PATENT DOCUMENTS

| | | | | |
|---|---|---|---|---|
| CN | 105283598 | | 1/2016 | |
| CN | 109423804 | | 3/2019 | |
| EP | 2947197 | | 11/2015 | |
| EP | 2691567 | B1 * | 11/2016 | ..... D06F 58/22 |
| JP | 2003-053089 | A | 2/2003 | |
| JP | 2010029439 | | 2/2010 | |
| KR | 10-2011-0123360 | A | 11/2011 | |
| KR | 10-2019-0128496 | A | 11/2019 | |
| WO | WO-2011139097 | A2 * | 11/2011 | ..... D06F 58/22 |
| WO | WO 2014/095465 | | 6/2014 | |
| WO | WO 2018/162081 | | 9/2018 | |

OTHER PUBLICATIONS

International Search Report and Written Opinion in International Appln. No. PCT/KR2020/018403, dated Apr. 6, 2021, 9 pages.
Office Action in Korean Appln. No. 10-2019-0169253, mailed on Oct. 28, 2024, 15 pages (with English translation).
Invention Patent in Chinese Appln. No. 202080088279.7, mailed on Jun. 20, 2023, 44 pages (with English translation).

* cited by examiner

[Fig. 4]
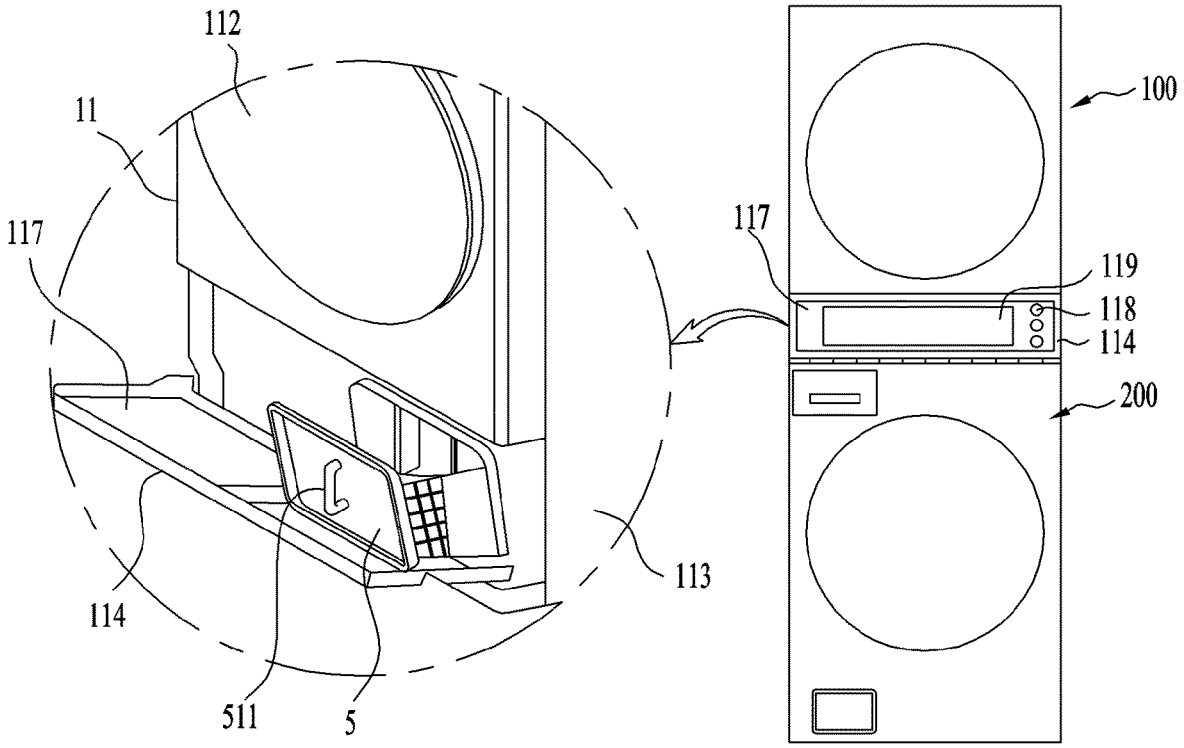
[Fig. 5]
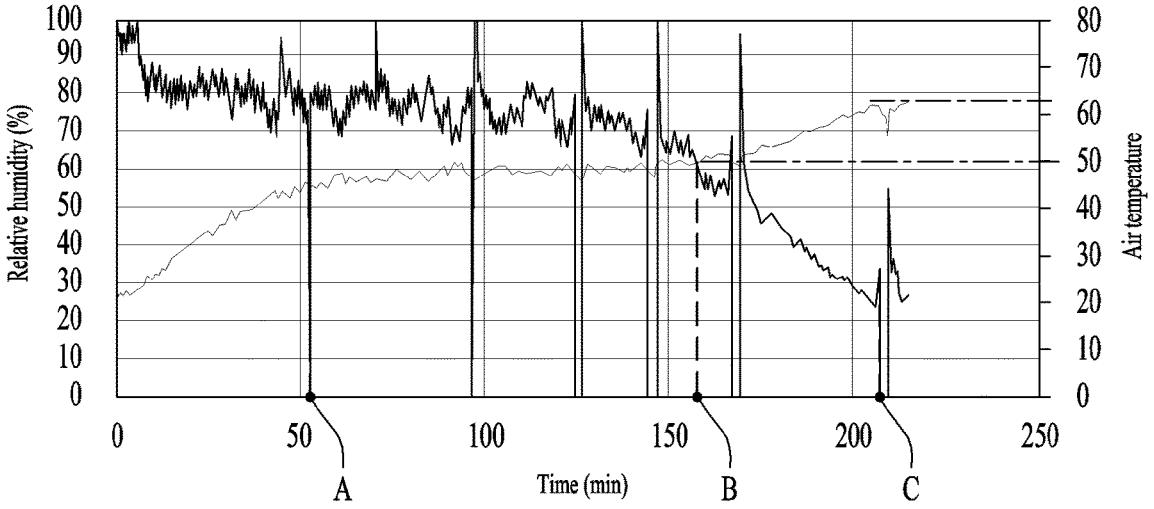

LAUNDRY TREATING APPARATUS AND METHOD FOR CONTROLLING THE LAUNDRY TREATING APPARATUS

CROSS-REFERENCE TO RELATED APPLICATIONS

This application is a National Stage application under 35 U.S.C. § 371 of International Application No. PCT/KR2020/018403, filed on Dec. 16, 2020, which claims the benefit of Korean Application No. 10-2019-0169253, filed on Dec. 17, 2019. The disclosures of the prior applications are incorporated by reference in their entirety.

TECHNICAL FIELD

The present disclosure relates to a laundry treating apparatus and a method for controlling the laundry treating apparatus.

BACKGROUND ART

A laundry treating apparatus refers to a generic term of an apparatus for washing laundry, an apparatus for drying laundry, and an apparatus capable of washing and drying laundry.

A conventional laundry treating apparatuses capable of drying laundry may include a drum that provides a space for storing laundry, a duct that defines a channel that resupplies air discharged from the drum to the drum, a first heat exchanger that cools air introduced into the duct from the drum to remove moisture included in the air, a second heat exchanger that heats air that has passed through the first heat exchanger, and a fan that moves air passing through the second heat exchanger to the drum.

In the conventional laundry treating apparatus having the above structure, the air discharged from the drum is dehumidified and heated while passing through the heat exchangers, and then is resupplied to the drum. Thus, contaminants such as lint remain in the heat exchangers. To solve such a problem, each of some conventional laundry treating apparatuses is configured to include a filter for filtering air flowing from the drum to the duct and an water ejector for ejecting water to the filter to clean the filter (EP2691567B1).

The conventional laundry treating apparatus capable of cleaning the filter may minimize a problem of deteriorating drying performance in that the apparatus may clean the filter. However, there is a disadvantage that the apparatus may not keep the filter and contaminants dry because the apparatus is free of means or a process for drying the cleaned filter.

Further, in the conventional laundry treating apparatus, water (condensate water) as discharged from air passing through the first heat exchanger may be stored in a water collector, and the filter may be cleaned with water stored in the water collector. The laundry treating apparatuses may generally have an ejector to eject the condensate water to the filter, and a collection channel for collecting the ejected condensate water back to the water collector. However, the laundry treating apparatus having the collection channel has a disadvantage in that the condensate water could not move to the water collector through the collection channel when there are a lot of contaminants remaining in the filter.

DISCLOSURE OF INVENTION

Technical Problem

A purpose of the present disclosure is to provide a laundry treating apparatus and a method for controlling the laundry treating apparatus, in which a filter assembly as cleaned and contaminants remaining in the filter assembly may be kept in a dry state.

Further, a purpose of the present disclosure is to provide a laundry treating apparatus and a method for controlling the laundry treating apparatus, which may be capable of minimizing a phenomenon that water ejected into the filter assembly may not be collected into the water collector due to contaminants remaining in the filter assembly.

Solution to Problem

The present disclosure provides a method for controlling a laundry treating apparatus, the method including: a drying operation in which a heat exchanger sequentially carries out dehumidification and heating of air introduced into a circulation channel (duct) until a dryness of laundry stored in a drum reaches a predefined target dryness, wherein the circulation channel resupplies air discharged from a drum back to the drum; a dryness measurement operation of measuring a dryness of laundry during the drying operation; and a cleaning operation in which when the dryness of laundry is higher than a first reference dryness as set to be lower than the target dryness, water from is supplied from a water collector constructed to store therein condensate water generated during the dehumidification to the water ejector, thereby to clean a filter assembly that filters air to be supplied to the heat exchanger. In this connection, when the dryness of the laundry measured during the drying operation is greater than or equal to a second reference dryness as set to be higher than the first reference dryness, the cleaning operation is configured not to be executed, thereby to minimize an amount of water remaining in the filter assembly and an amount of water remaining in contaminants remaining in the filter assembly.

One aspect of the present disclosure provides a method for controlling a laundry treating apparatus, wherein the laundry treating apparatus comprises: a drum having a laundry storage space defined therein; a duct defining a channel for supplying air discharged from the drum back to the drum; a fan to move air along the duct; a heat-absorber for removing moisture from air introduced into the duct; a heat-emitter disposed inside the duct to heat air passing through the heat-absorber; a water collector for storing therein water discharged from air passing through the heat-absorber; a filter assembly including a first filter to filter fluid moving to the heat-absorber and a second filter fixed to the first filter to filter fluid moving to the water collector; a water discharger having a water storage space defined therein; a water discharger supply pipe for supplying water stored in the water collector to the water discharger; a water ejector configured to eject water into the first filter; and a water ejector supply pipe for supplying water stored in the water collector to the water ejector; wherein the method comprises: a drying operation in which the fan, the heat-absorber, and the heat-emitter works to conduct heat exchange between air and laundry inside the drum, wherein the drying operation is executed until a dryness of laundry reaches a predefined target dryness; a dryness measurement operation in which a dryness of laundry is measured using at least one of an electrode sensor or a humidity sensor during the drying operation, wherein the humidity sensor measures a humidity of air flowing from the drum to the duct, and wherein the electrode sensor contacts the laundry and measures an amount of moisture contained in the laundry; and a cleaning operation in which when the dryness of the laundry is higher than a first reference dryness lower than the target dryness, water is supplied from the water collector to the water ejector to clean at least one of the filter assembly or the heat-absorber.

In one implementation of the method, the cleaning operation is not performed when the dryness of the laundry is greater than or equal to a second reference dryness higher than the first reference dryness.

In one implementation of the method, the method further comprises a water-level measurement operation in which a water collector water-level sensor measures a water-level inside the water collector during the drying operation, wherein the cleaning operation is initiated when the water-level inside the water collector is higher than or equal to a predefined cleaning-related reference water-level.

In one implementation of the method, the method further comprises a water discharge operation in which when the dryness of laundry is higher than or equal to the second reference dryness, and the water-level inside the water collector is greater than or equal to a discharge reference water-level higher than or equal to the cleaning-related reference water-level, water flows from the water collector to the water discharger.

In one implementation of the method, the method further comprises a water discharge operation in which when the dryness of laundry is lower than the first reference dryness, and the water-level inside the water collector is greater than or equal to a discharge reference water-level higher than or equal to the cleaning-related reference water-level, water flows from the water collector to the water discharger.

In one implementation of the method, the first reference dryness is set to a dryness equal to 30% to 35% of the target dryness.

In one implementation of the method, the method further comprises a temperature measurement operation in which a temperature of air discharged from the drum is measured using a temperature sensor for measuring a temperature of air introduced into the duct, during the drying operation, wherein the first reference dryness is set to a dryness at which a temperature increase rate per minute of air discharged from the drum is smaller than 0.1 degrees Celsius per minute, wherein the second reference dryness is set to a dryness at which a temperature increase rate per minute of air discharged from the drum is equal to or larger than 0.1 to 0.2 degrees Celsius per minute.

In one implementation of the method, the method further comprises a temperature measurement operation in which a temperature of air discharged from the drum is measured using a temperature sensor for measuring a temperature of air introduced into the duct, during the drying operation, wherein the second reference dryness is equal to or greater than 42% to 46% of the target dryness, and is set to a dryness at which a temperature increase rate per minute of air discharged from the drum is equal to or larger than 0.1 to 0.2 degrees Celsius per minute.

Another aspect of the present disclosure provides a laundry treating apparatus comprising: a cabinet having a laundry inlet and a filter insertion hole defined in a front face thereof; a drum rotatably disposed inside the cabinet and having a laundry storage space defined therein communicating with the laundry inlet; a duct disposed inside the cabinet, wherein the duct defines a channel for supplying air discharged from the drum back to the drum; a fan to move air along the duct; a heat exchanger including a heat-absorber to remove moisture from air introduced into the duct and a heat-emitter disposed inside the duct to heat air passing through the heat-absorber; a water collector constructed to communicate with the duct and to store therein water discharged from the water passing through the heat-absorber; a filter assembly including: a filter assembly body attachable to or detachable from the duct and constructed to be extended from or retractable into the cabinet through the filter insertion hole; a first filter disposed in the filter assembly body to filter fluid moving to the heat-absorber; and a second filter disposed in the filter assembly body to filter fluid moving to the water collector, wherein the second filter is positioned below the first filter; a water discharger detachably disposed in the cabinet and having a water storage space defined therein; a water discharger supply pipe for supplying water stored in the water collector to the water discharger; a water ejector configured to eject water into the first filter; and a water ejector supply pipe for supplying water stored in the water collector to the water ejector.

In one implementation of the apparatus, the second filter is disposed on a bottom face of the filter assembly body extending from a bottom of the first filter toward the filter insertion hole.

In one implementation of the apparatus, the apparatus further comprises: a bypass hole defined in a face of the filter assembly body free of the first filter and the second filter, wherein the bypass hole communicates an inside of the filter assembly body with the water collector; and a third filter disposed in the bypass hole.

In one implementation of the apparatus, the first filter has an inclination of 90 degrees to 100 degrees from a bottom face of the filter assembly body toward a front face of the heat-absorber, wherein the second filter has an inclination of 10 degrees to 20 degrees upward from a bottom of the first filter toward the filter insertion hole, wherein the bypass hole is located at a level higher than a top level of the second filter and lower than a top level of the first filter.

In one implementation of the apparatus, the apparatus further comprises: an insertion hole door rotatably disposed on the cabinet to open and close the filter insertion hole; and a control panel including at least one of a display for displaying a command selected by a user or an input interface for receiving a control command from the user, wherein the control panel is fixed to the insertion hole door.

In one implementation of the apparatus, the insertion hole door is disposed on a bottom of the front panel.

Advantageous Effects of Invention

The present disclosure may realize the laundry treating apparatus and the method for controlling the laundry treating apparatus, in which the filter assembly as cleaned and contaminants remaining in the filter assembly may be kept in a dry state.

Further, the present disclosure may realize the laundry treating apparatus and the method for controlling the laundry treating apparatus, which may be capable of minimizing a phenomenon that water ejected into the filter assembly may not be collected into the water collector due to contaminants remaining in the filter assembly.

BRIEF DESCRIPTION OF DRAWINGS

FIG. 4 shows another example of a laundry treating apparatus.

FIG. 5 and FIG. 6 show one example of a method for controlling a laundry treating apparatus.

BEST MODE FOR CARRYING OUT THE INVENTION

Figure 1:
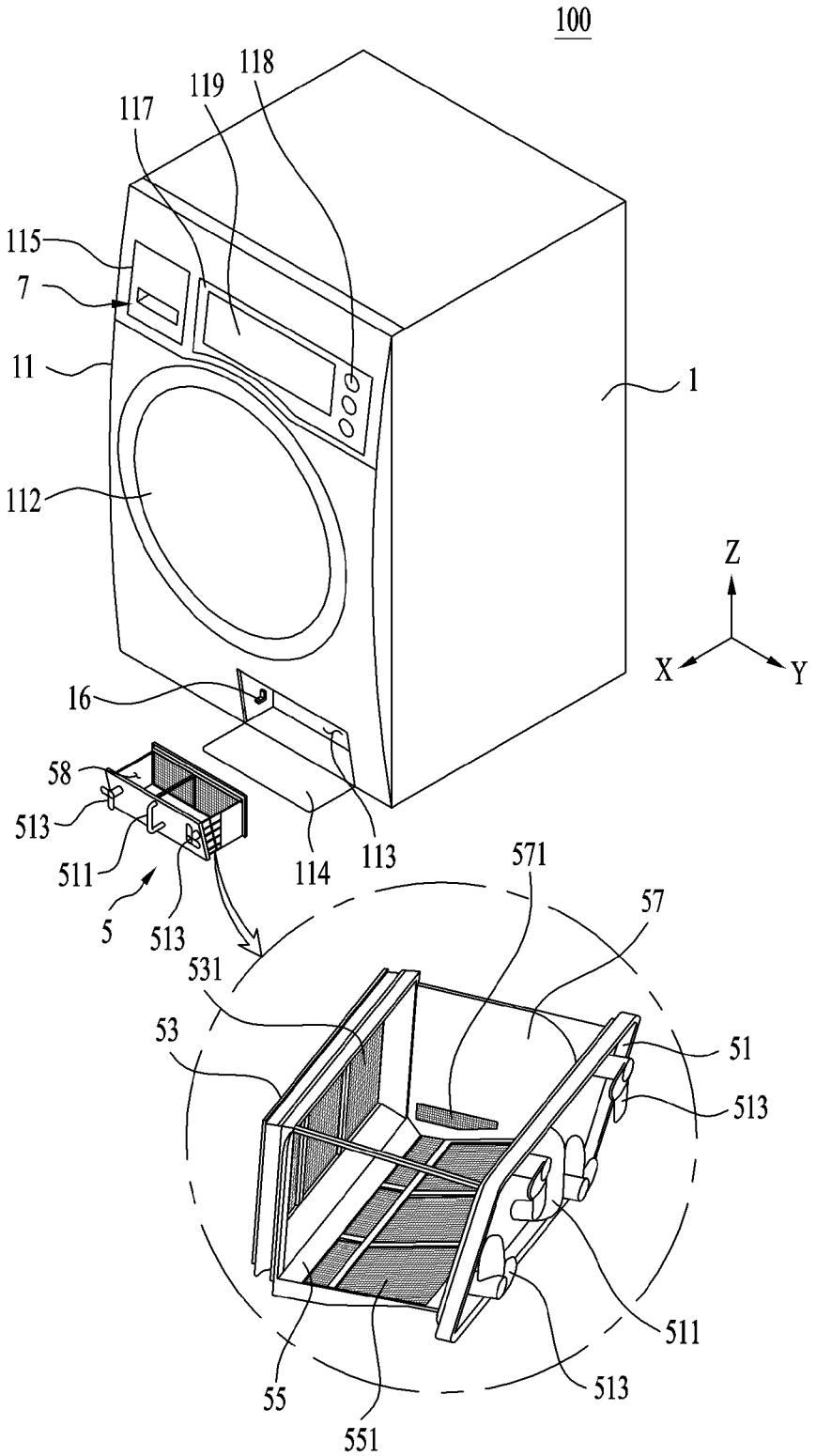
FIG. 1 and FIG. 2 show one example of a laundry treating apparatus.

Hereinafter, preferred embodiments of a laundry treating apparatus and a control method thereof may be described in detail with reference to the accompanying drawings. A configuration or a control method of an apparatus to be described below are intended only for describing examples of an laundry treating apparatus and a control method thereof, and is not intended to limit a scope of the disclosure. The same reference numerals throughout the specification represent the same elements.

Figure 2:
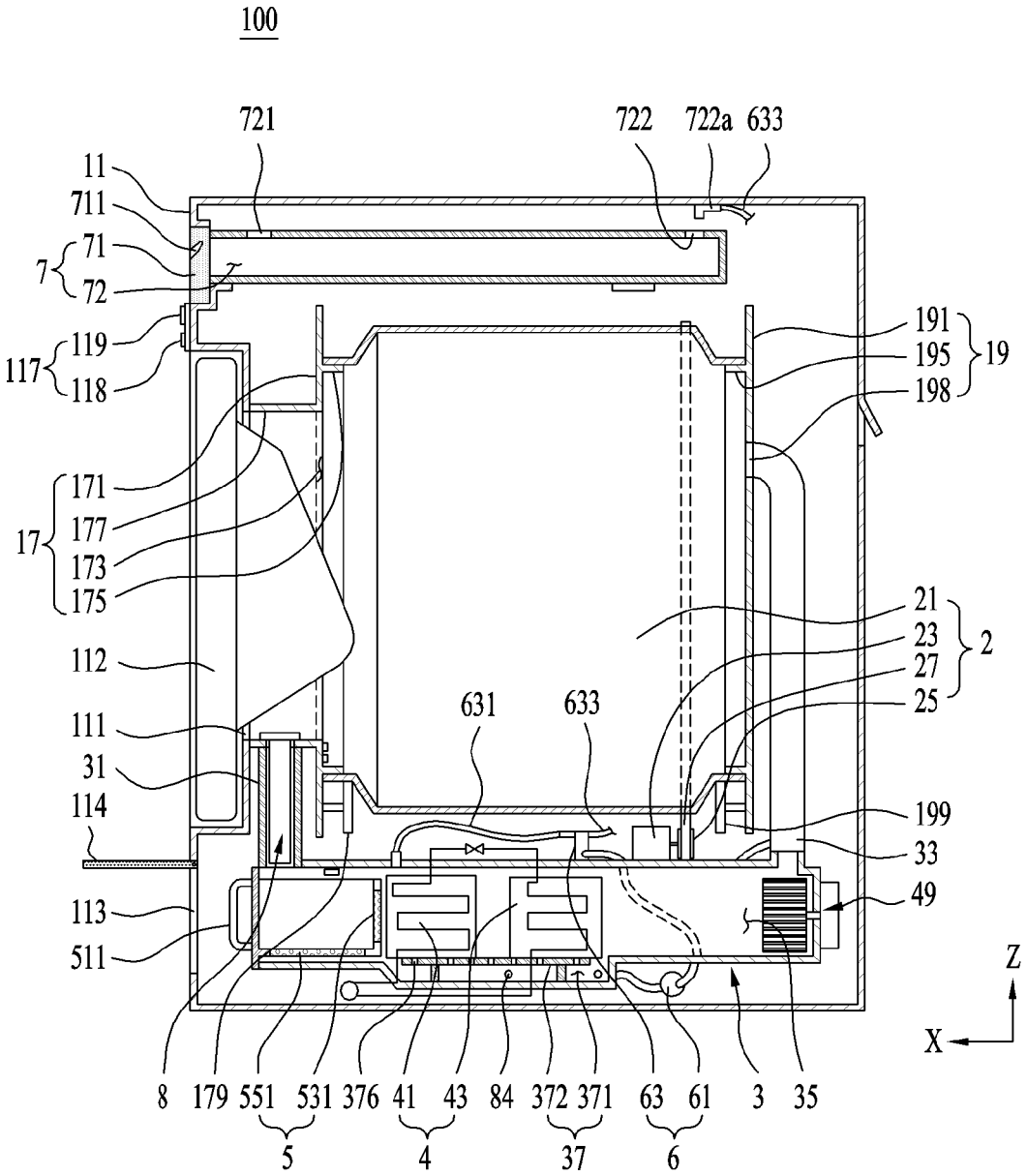

FIG. 1 and FIG. 2 show one example of a laundry treating apparatus 100. As shown in FIG. 2, the laundry treating apparatus 100 may include a cabinet 1, a drum rotatably received in the cabinet and having a laundry storage space therein, a duct 3 that defines a channel for resupplying air discharged from the drum 2 to the drum 2, and a heat exchanger 4 that dehumidifies and heats air introduced into the duct 3 and then resupplies the same to the drum 2.

As shown in FIG. 1, the cabinet 1 may be configured to include a front panel 11 defining a front face of the laundry treating apparatus. The front panel 11 has a cabinet laundry inlet 111 defined therein and constructed to communicate with the drum 2. The cabinet laundry inlet 111 may be constructed to be opened and closed by a door 112 pivotably coupled to the cabinet.

A control panel 117 may be disposed on the front panel 11. The control panel 117 may include an input interface 118 for receiving a control command from a user and a display 119 for outputting information such as a control command selectable by the user.

The input interface 118 may include a power supply request unit that requests power supply to the laundry treating apparatus, a course input interface that enables a user to select a desired course from among a plurality of courses, and an execution request unit that requests initiation of a course selected by the user. The display 119 may include at least one of a display panel capable of outputting texts and figures, and a speaker capable of outputting audio signals and sounds.

As shown in FIG. 2, when the drum 2 is embodied as a cylindrical drum body 21 with open front and rear faces, the cabinet 1 may contain a first support 17 rotatably supporting a front face of the drum 2, and a second support 19 rotatably supporting a rear face of the drum 2.

The first support 17 may include a first fixed body 171 fixed disposed inside the cabinet 1, a drum laundry inlet 173 constructed to pass through the first fixed body and to communicate the cabinet laundry inlet 111 with an inside of the drum body 21, and a first support body 175 disposed on the first fixed body 171 and inserted into a front face (a first opening) of the drum body 21.

The first fixed body 171 may have any shape as long as the drum laundry inlet 173 is defined therein and the first support body 175 is disposed thereon. The first support body 175 may be embodied as a pipe shape protruding from the first fixed body 171 toward the drum body 21. A diameter of the first support body 175 may be larger than a diameter of the drum laundry inlet 173 and may be smaller than a diameter of the front face of the drum body 21. In this case, the drum laundry inlet 173 may be located inside a space defined by the first support body 175.

Figure 3:
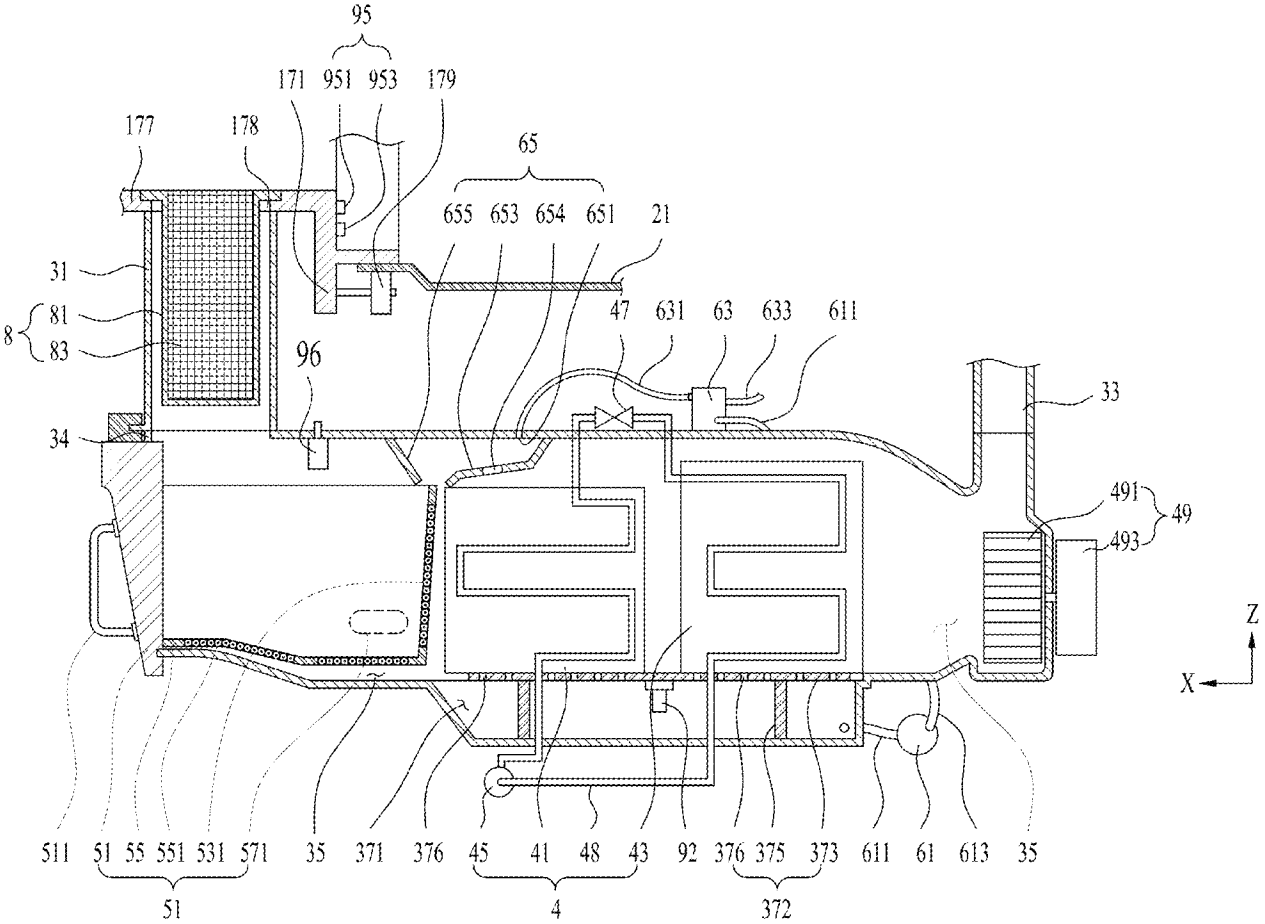
FIG. 3 shows an example of a heat exchanger and a cleaner disposed in a laundry treating apparatus.

The first support 17 may be constructed to further include a connection body 177 connecting the cabinet laundry inlet 111 and the drum laundry inlet 173 with each other. The connection body 177 may be embodied as a pipe shape extending from the drum laundry inlet 173 toward the cabinet laundry inlet 111. The connection body 177 may have an air outlet 178 defined therein that communicates with the duct 3. As shown in FIG. 3, the air outlet 178 refers to a passage that allows air inside the drum body 21 to move to the duct 3 therethrough, and may be embodied as a through-hole defined to pass through the connection body 177.

As shown in FIG. 2, the second support 19 may include a second fixed body 191 disposed fixedly inside the cabinet 1 and a second support body 195 disposed on the second fixed body 191 and inserted into a rear face (a second opening) of the drum body 21. The second support 19 may have an air inlet 198 defined therein to pass through the second fixed body 191 and communicate the inside of the drum body 21 with the inside of the cabinet 1. In this case, the duct 3 may be constructed to connect the air outlet 178 and the air inlet 198 to each other.

The cylindrical drum body 21 having an empty inner space defined therein may rotate via various types of drivers. FIG. 2 illustrates one example where the driver may be configured to include a motor 23 disposed fixedly inside the cabinet 1, a pulley 25 rotated by the motor, and a belt 27 connecting a circumferential surface of the pulley 25 and a circumferential surface of the drum body 21 with each other.

In this case, the first support 17 may include a first roller 179 rotatably supporting a circumferential surface of the drum body 21. The second support 19 may have a second roller 199 that rotatably supports a circumferential surface of the drum body.

The duct 3 may be configured to include a discharge duct 31 connected to the air outlet 178, a supply duct 33 connected to the air inlet 198, and a connection duct 35 connecting the discharge duct and the supply duct with each other.

The heat exchanger 4 may be embodied as a variety of devices capable of sequentially performing dehumidification and heating of the air introduced into the duct 3.

FIG. 3 illustrates one example where the heat exchanger is embodied as a heat pump.

The heat exchanger 4 shown in FIG. 3 may include a fan 49 that moves air along the duct 3, a first heat exchanger (heat-absorber) 41 that removes moisture from the air flowing into the duct 3, and a second heat exchanger (heat-emitter) 43 disposed inside the duct 3 to heat air passing through the first heat exchanger 41.

The fan 49 may be configured to include an impeller 491 disposed inside the duct 3 and an impeller motor 493 rotating the impeller 491. The impeller 491 may be disposed in any one of the discharge duct 31, the connection duct 35, and the supply duct 33. FIG. 3 illustrates one example where the impeller 491 is installed in the supply duct 33 (is located in rear of the heat-emitter).

The heat-absorber 41 may be embodied as a plurality of metal plates arranged along a Y-axis direction (in a width direction of the connection duct 35) or a Z-axis direction (in a height direction of the connection duct). The heat-emitter 43 may be embodied as a plurality of metal plates arranged along the width direction of the connection duct or the height direction of the connection duct. The heat-absorber 41 and the heat-emitter 43 may be sequentially arranged in the connection duct 35 in a direction from the discharge duct 31 to the supply duct 33, and may be connected to each other through a refrigerant pipe 48 that defines a circulation channel of refrigerant.

The refrigerant may flow along the refrigerant pipe 48 by a compressor 45 located outside the duct 3. A pressure adjuster 47 may be disposed at the refrigerant pipe 48 to control a pressure of the refrigerant that has passed through the heat-emitter 43.

The heat-absorber 41 may refer to means to cool the air and evaporate the refrigerant by transferring heat of the air flowing into the discharge duct 31 to the refrigerant. The heat-emitter 43 may refer to means for heating the air and condensing the refrigerant by transferring heat from the refrigerant that has passed through the compressor 45 to the air. In this case, moisture contained in the air may be collected on a bottom face of the connection duct 35 along a surface of the heat-absorber 41 as the air passes through the heat-absorber 41.

A water collector 37 may be disposed in the laundry treating apparatus 100 to collect water removed from the air passing through the heat-absorber 41. FIG. 3 shows an example where the water collector 37 is located inside the connection duct 35.

The water collector 371 and 372 in FIG. 3 may include a water collector body 371 that is fixed to a bottom face of the connection duct 35 and communicates with the inside of the connection duct. To prevent the heat-absorber 41 and the heat-emitter 43 from contacting water (condensate water) stored in the water collector body 371, a heat exchanger support 372 may be further disposed inside the water collector body 371. The heat exchanger support 372 may be configured to include a support plate 373 with which the heat-absorber 41 and the heat-emitter 43 are in contact, a pacer 375 to maintain a space between the support plate 373 and a bottom face of the water collector body 371, and a support plate through-hole 376 constructed to pass through the support plate 373.

The support plate through-hole 376 may be defined only in a portion of the support plate 373 on which the heat-absorber 41 is supported, or may be defined in a portion thereof on which the heat-absorber is supported and a portion thereof on which the heat-emitter is supported. When the support plate through-hole 376 is defined under the heat-emitter 43, water transferred to the heat-emitter 43 along the support plate 373 may be discharged to the water collector body 371 (thus, preventing decrease in heat transfer efficiency that may otherwise occur when the heat-emitter contacts the water).

In order to minimize accumulation of contaminants (lint) discharged from the drum body 21 on the heat-absorber 41 and the heat-emitter 43, a filter assembly for filtering air may be further disposed in the laundry treating apparatus 100. FIG. 3 illustrates one example where the filter assembly includes a first filter assembly 5 disposed in the connection duct 35 and a second filter assembly 8 disposed in the discharge duct 31.

The second filter assembly 8 may be embodied as means for filtering air flowing from the drum body 21 into the discharge duct 31. The first filter assembly 5 may be disposed between the second filter assembly 8 and the heat-absorber 41 and may be embodied as means for filtering air that has passed through the second filter assembly. A diameter of a filter hole defined in the first filter assembly 5 may be set to be smaller than a diameter of a filter hole defined in the second filter assembly 8.

The second filter assembly 8 may include a frame 81 detachably inserted into the discharge duct 31 through the air outlet 178, and a fourth filter 83 disposed in the frame to filter air.

The first filter assembly 5 may be detachably disposed in the connection duct 35. In this case, a filter insertion hole 113 (refer to FIG. 1) through which the first filter assembly 5 is drawn out may be defined in the front panel 11 of the cabinet, and an insertion hole door 114 to open and close the filter insertion hole may be disposed thereon. The duct 3 may have a duct through-hole 34 (refer to FIG. 3) defined therein into which the first filter assembly 5 is inserted. Therefore, the user may separate the first filter assembly 5 from the laundry treating apparatus and remove the contaminants remaining in the first filter assembly 5 and clean the second filter assembly, when necessary.

As shown in FIG. 1, the first filter assembly 5 may include a filter assembly body 51, 53, and 57, 58 inserted into the filter insertion hole 113 and the duct through-hole 34, and positioned between the second filter assembly 8 and the heat-absorber 41, and filters 531, 551, and 571 that are disposed in the filter assembly body and filter fluid (air and water) moving to the heat-absorber 41 and the water collector body 371.

The filter assembly body may be implemented in various forms depending on a shape of a cross-section (Y-Z plane and X-Z plane) of the connection duct 35. FIG. 1 shows an example where the filter assembly body has a shape similar to a hexahedron.

In this case, the filter assembly body may be configured to include a front face 51 having a shape capable of closing the duct through-hole 34, a rear face 53 located between the front face and the heat-absorber 41, a bottom face 55 constructed to connect the front face and the rear face to each other, and a first side face 57 and a second side face 58 defining left and right side faces of the filter assembly body, respectively.

On the front face 51, a lock 513 may be disposed that may be removably engaged with a lock fastener 16 disposed on the cabinet. FIG. 1 shows one example where the lock 513 is embodied as a bar rotatably coupled to the front face 51 of the filter assembly body, and the lock fastener 16 has a groove defined therein to receive therein a free end of the bar. The lock 513 may be disposed on each of opposite sides of the front face 51, and the lock fastener 16 may be disposed on each of opposite sides of the filter mounting hole 113.

A handle 511 may be further disposed on the front face 51 to facilitate inserting the filter assembly body into the connection duct 35 or removing the same from the connection duct 35.

A first filter 531 and a second filter 551 for filtering fluid (air and water) introduced into the filter assembly body may be disposed on the rear face 53 and the bottom face 55, respectively. The rear face 53 may have a rear face through-hole defined therein to communicate an inside of the filter assembly body with an inner space of the duct 3. The first filter 531 may be disposed in the rear face through-hole. The bottom face 55 may have a bottom face through-hole defined therein that communicates the inside of the filter assembly body with the interior space of the duct 3. The second filter 551 may be disposed in the bottom face through-hole. Therefore, the first filter 531 may act as means for filtering fluid (air and water) to be supplied to the heat-absorber 41, while the second filter 551 may act as means for filtering the fluid to be supplied to the water collector body 371.

The first side face 57 and the second side face 58 may be constructed to connect the front face 51, the rear face 53 and the bottom face 55 to each other.

The first filter assembly 5 having the above-described structure may be constructed to communicate with the discharge duct 31 through a top face or the second side face 58 of the filter assembly body. FIG. 1 shows an example where the first filter assembly 5 is connected to the discharge duct 31 through a top face through-hole constructed to pass through the top face of the filter assembly body and a side face through-hole constructed to pass through the second side face 58.

As shown in FIG. 3, the first filter 531 may have an inclination of 90 degrees to 100 degrees toward a front face of the heat-absorber 41 relative to the bottom face 55 of the filter assembly body. Thus, when water is ejected to the first filter 531 using the cleaner 6 which may be described later, contaminants remaining in the first filter may easily move to the bottom face 55.

The second filter 551 may have an inclination of 10 degrees to 20 degrees downward from the front face 51 toward the first filter 531 (the second filter may have an inclination of 10 to 20 degrees upward from a bottom of the first filter toward the filter insertion hole. When the second filter 551 is inclined downward toward the first filter 531, a connection point of the first filter assembly between the first filter 531 and the second filter 551 may be the lowest point. Thus, the contaminants of the first filter assembly 5 may be concentrated on the connection point between the first filter 531 and the second filter 551. When the contaminants are concentrated on the connection point of the first filter 531 and the second filter 551, the user may be able to remove the contaminants more easily inside the first filter assembly 5.

However, when the contaminants are concentrated on the connection point of the first filter 531 and the second filter 551, it may take a long time for the water ejected from the cleaner 6 to be discharged to the water collector body 371. To solve this problem, as shown in FIG. 1, the first side face 57 may have a bypass hole defined therein that communicates the inside of the first filter assembly 5 to the water collector body 371 and a third filter 571 may be disposed in the bypass hole. As shown in FIG. 3, the bypass hole and the third filter 571 may be disposed at a level higher than a top level of the second filter 551 and lower than a top level of the first filter 531. Thus, the laundry treating apparatus may minimize a phenomenon that water ejected to the first filter assembly 5 may not be collected into the water collector body 371 due to the contaminants remaining in the first filter assembly 5.

As shown in FIG. 2, the laundry treating apparatus 100 may further include a cleaner 6 which uses the water stored in the water collector body 371 to clean the first filter assembly 5, and a water discharger 7 which discharges the water inside the water collector body 371 to an outside of the water collector body 371.

As shown in FIG. 3, the cleaner 6 may be embodied as means for cleaning at least one of the first filter 531, the second filter 551, the third filter 571, and the heat-absorber 41 by ejecting the water stored in the water collector body 371 into the first filter assembly 5. The cleaner 6 may be configured to include a water ejector 65 that is disposed at the duct 3 and supplies water to the first filter assembly 5, and a pump 61 that moves water stored in the water collector body 371 to the water ejector 65.

The pump 61 may be connected to the water collector body 371 through a first connection pipe 611, and may be connected to the water ejector 65 through a second connection pipe 613. When the laundry treating apparatus 100 is configured to move the water from the water collector body 371 to the water ejector 65 and the water discharger 7 using only a single pump 61, the laundry treating apparatus 100 may further include a channel switch 63. In this case, the channel switch 63 may be connected to the pump 61 through the second connection pipe 613. The water ejector 65 may be connected to the channel switch 63 through a water ejector supply pipe 631. The water discharger 7 may be constructed to be connected to the channel switch 63 through a water discharger supply pipe 633.

The channel switch 63 may include a valve that controls opening and closing of the water ejector supply pipe 631 and a valve that controls opening and closing of the water discharger supply pipe 633. Therefore, the laundry treating apparatus 100 may control the valves disposed in the channel switch 63 such that the water stored in the water collector body 371 may be supplied to the water ejector 65 or the water discharger 7.

The water ejector 65 includes a duct through-hole 651 passing through the connection duct 35, and connected to the water ejector supply pipe 631, a first guide 653 which guides water supplied from the duct through-hole to the first filter 531, and a second guide 655 constructed to guide at least a portion of the water supplied through the first guide 653 to a front face of the heat-absorber 41. In this case, the second guide 655 may be embodied as means for supplying water to the front face of the heat-absorber 41 through the first filter 531. That is, the first filter 531 may be positioned between the first guide 653 and the second guide 655 when the first filter assembly 5 is fixed to the connection duct 35. The second guide 655 may be embodied as an inclined face inclined downward from a top face of the connection duct 35 toward the first filter 531.

A guide through-hole 654 may be further defined in the first guide 653. The guide through-hole 654 may refer to a hole passing through the first guide 653. Thus, the water introduced into the duct through-hole 651 may be supplied to a front region of the heat-absorber 41 through the guide through-hole 654. The front region of the heat-absorber refers to a region thereof facing toward the first filter 531 in a vertical line passing through a center of the heat-absorber 41.

As shown in FIG. 2, the water discharger 7 may include a water storage body 72 that is detachably disposed on the cabinet 1 and had a space defined therein for storing water, and an inlet 722 constructed to pass through the water storage body 72 and to introduce water discharged from the water discharger supply pipe 633 into the water storage body 72.

The water storage body 72 may be embodied as a drawer-type tank which may extend or retract from or into the cabinet 1. In this case, a water discharger insertion hole into which the water storage body 72 is inserted should be defined in the front panel 11 of the cabinet. A panel 71 may be fixed to a front face of the water storage body 72. The panel 71 may be constructed to be detachably coupled to the water discharger insertion hole to define a portion of the front panel 11.

A groove 711 into which a user's hand is inserted may be further defined in the panel 71. In this case, the panel 71 may act as a handle to allow the user to pull the water storage body 72 out of the cabinet or insert the same into the cabinet.

The inlet 722 may be constructed to receive water discharged from the nozzle 722*a* fixed to the cabinet 1. A nozzle 722*a* may be fixed to the top panel 13 of the cabinet so that the nozzle is positioned above the inlet 722 when the water storage body 72 is inserted into the cabinet 1. In this case, the water discharger supply pipe 633 should be constructed to connect the nozzle 722*a* and the channel switch 63 with each other.

The water discharger 7 having the above structure may be configured such that the user pulls the water storage body 72 out of the cabinet 1 and then flips or tilts the water storage body 72 toward the inlet 722 such that the water inside the water storage body 72 may be discarded. A communication hole 721 may be constructed to pass through a top face of the water storage body 72 so that the water inside the water storage body 72 is easily discharged through the inlet 722.

As shown in FIG. 3, the laundry treating apparatus 100 is preferably configured to include a water collector water-level sensor 91 that measures a water-level of the water collector body 371 and transmits the same to the controller. When the water collector water-level sensor 91 is disposed, the laundry treating apparatus may determine a timing of moving the water stored in the water collector body 371 to the water storage body 72, and thus prevent the water from the water collector body 371 from flowing back to the connection duct 35.

The water collector water-level sensor 91 may be embodied as any device that may detect the water-level inside the water collector body 371. FIG. 3 show an example that the water collector water-level sensor 91 may be embodied as a sensor having a plurality of electrodes having different lengths (the number of electrodes electrically connected to each other may vary according to the water-level).

To determine the dryness of laundry to determine an operation stop timing of the heat exchanger 4, a dryness sensor may be disposed in the laundry treating apparatus 100. The dryness sensor may be embodied as at least one of an electrode sensor 95 which measures an amount of moisture contained in laundry, or a humidity sensor that measures a humidity of air flowing from the drum 2 to the duct 3.

The electrode sensor may be configured to include a first electrode 951 and a second electrode 953 that are fixed to the first fixed body 171 and contact the laundry inside the drum body 21. As the dryness increases, an amount of moisture contained in the laundry may decrease, such that an electrical resistance of the laundry increases. Thus, the laundry treating apparatus 100 may determine the dryness of the laundry based on the electrical resistance measured when the two electrodes 951 and 953 are connected to each other via laundry. In one example, as the dryness of laundry increases, the amount of moisture contained in the air flowing into duct 3 may decrease. Thus, the laundry treating apparatus 100 may also determine the dryness of laundry based on the humidity of air introduced into the duct 3 as measured via the humidity sensor.

Further, the laundry treating apparatus 100 may further include a temperature sensor 96 that measures a temperature of air introduced into the duct 3. The temperature sensor 96 may be fixed to a top face of the connection duct 35 and may be constructed to be positioned between the first filter 531 and the second filter 551.

FIG. 4 shows another embodiment of the laundry treating apparatus 100. The laundry treating apparatus 100 according to this embodiment is characterized in that the control panel 117 is disposed on the insertion hole door 114. The insertion hole door 114 is rotatably disposed on a bottom of the front panel 11. Therefore, when the control panel 117 is disposed on the insertion hole door 114, and when the above-described laundry treating apparatus 100 (first laundry treating apparatus) is mounted on a top face of a separate apparatus 200 (second laundry treating apparatus, etc.), the user may easily manipulate the first laundry treating apparatus 100.

The insertion hole door 114 in this embodiment may be constructed such that a width thereof is the same as that of the front panel 11, and may be rotatably coupled to the front panel 11 and may be located under the laundry inlet 111.

The laundry treating apparatus 100 having the above-described structure may dry the laundry using a following process. When the controller (not shown) operates the fan 49, the compressor 45 and the pressure adjuster 47, the air inside the drum body 21 moves along the duct 3. The air introduced into the duct may be dehumidified and heated while passing through the heat-absorber 41 and the heat-emitter 43, and then may be supplied to the drum body 21, so that the laundry inside the drum body 21 may be dried.

FIG. 5 shows one example of a humidity and a temperature measured by the dryness sensor (humidity sensor) and the temperature sensor 96 during the above process. In a graph in FIG. 5, a thick line refers to the humidity data measured by the humidity sensor (humidity data of the air introduced into the duct). A thin line refers to temperature data measured by the temperature sensor (temperature data of the air introduced into the duct).

As shown in FIG. 5, the humidity of the air flowing from the drum body 21 to the duct 3 is high (the dryness of the laundry is low), and the air temperature is low, at beginning of operation of the heat exchanger 4 (at beginning of a drying operation). Then, as the drying operation proceeds, the humidity of the air decreases, the dryness of the laundry increases, and the temperature of the air increases.

When the heat exchange between laundry and air is active, a temperature change of the air discharged from the drum body 21 is almost constant. According to FIG. 5, a period for which the heat exchange between laundry and air supplied to the drum body 21 is active may refer to a period from a time point A to a time point B. At the time point A, the humidity of the air discharged from the drum body 21 is about 70% and the temperature of the air is about 45 degrees Celsius. At the time point B, the humidity of the air discharged from the drum body 21 is about 60%, and the temperature of the air is about 52 degrees Celsius. The time point B may be defined as a time point at which the humidity data and the temperature data intersect with each other.

When the humidity of the air discharged from the drum body 21 being 70% may correspond to the dryness of laundry being 30%, a time point A at which the heat exchange between air and laundry starts to become active may be defined as a time point at which the dryness of laundry is 30%, and the temperature of the air discharged from the drum body 21 is approximately 45 degrees Celsius. Further, the time point B may be defined as a time point at which the dryness of laundry is 40% and the temperature of the air discharged from the drum body 21 is approximately 52 degrees Celsius or higher.

From this point of view, FIG. 5 show one example where a time point (corresponding to a dryness target) at which the drying operation is terminated is set to the time point C where the humidity of the air discharged from the drum body 21 is approximately 10%. That is, FIG. 5 shows a case where approximately 90% is set as the target dryness. In this case, the time point A may be defined as a time point where the dryness of the laundry becomes approximately 30% to 35% of the target dryness (dryness at time point A/dryness at time point C=0.33).

In one example, a period for which the heat exchange between air and laundry active, that is, the first period as a period from the time point A to the time point B may refer to a period from a first time point at which approximately 50 minutes has elapsed after initiation of the drying operation to a second time point at which approximately 150 minutes has elapsed from the first time point. For this first period, the temperature of the air discharged from the drum body increases from approximately 45° C. to 52° C. Therefore, the first period may be defined as a period for which a temperature increase rate per minute of air discharged from the drum body 21 is lower than 0.1 degrees Celsius per minute.

When the first period is terminated, a second period for which a decrease rate in humidity and an increase rate in temperature of air discharged from the drum body are great is initiated.

According to FIG. 5, for the second period (from the time point B to the time point C), the humidity of air discharged from the drum body 21 decreases from 60% to 10% (the dryness of laundry increases from 40% to 90%), and the temperature of the air discharged from the drum body increases by greater than or equal to 10 degrees for about 50 minutes. The time point B may be defined as a time point at which the dryness of laundry is 42% to 46% of the target dryness (for example, dryness at time point B/dryness at time point C=0.44). Thus, the second period may be defined as a period for which the dryness of laundry is maintained to be approximately 42% to 46% or greater of the target dryness, and the temperature increase rate per minute of air discharged from the drum body is 0.2 degrees Celsius or greater per minute.

In one example, assuming that the experimental results in FIG. 5 are applied to a general laundry treating apparatus, the second period may be defined as a period for which the dryness of laundry is maintained to be approximately 42% to 46% or greater of the target dryness, and the temperature increase rate per minute of air discharged from the drum body is 0.1 degrees Celsius or greater per minute.

For the first period for which the heat exchange between air and laundry is active, the air discharged from the drum body 21 contains a lot of contaminants. Therefore, for the first period, a lot of contaminants may accumulate in the first filter assembly 5, the second filter assembly 8, and the heat-absorber 41. Thus, it is preferable that cleaning of the filter assemblies or the heat-absorber using the cleaner 6 is performed for the first period.

In one example, according to an experiment, the air discharged from the drum body for the second period contains a relatively small amount of contaminants than the air discharged from the drum body for the first period contains. Therefore, although for the second period, the cleaner 6 does not eject water into the filter assembly or the heat-absorber, the drying performance may not deteriorate significantly (the drying operation duration is not significantly increased), and the laundry treating apparatus 100 may be able to minimize an amount of the water remaining in the filter assembly, and the heat-absorber, and the contaminants remaining in the filter assembly when the drying operation is terminated.

Figure 6:
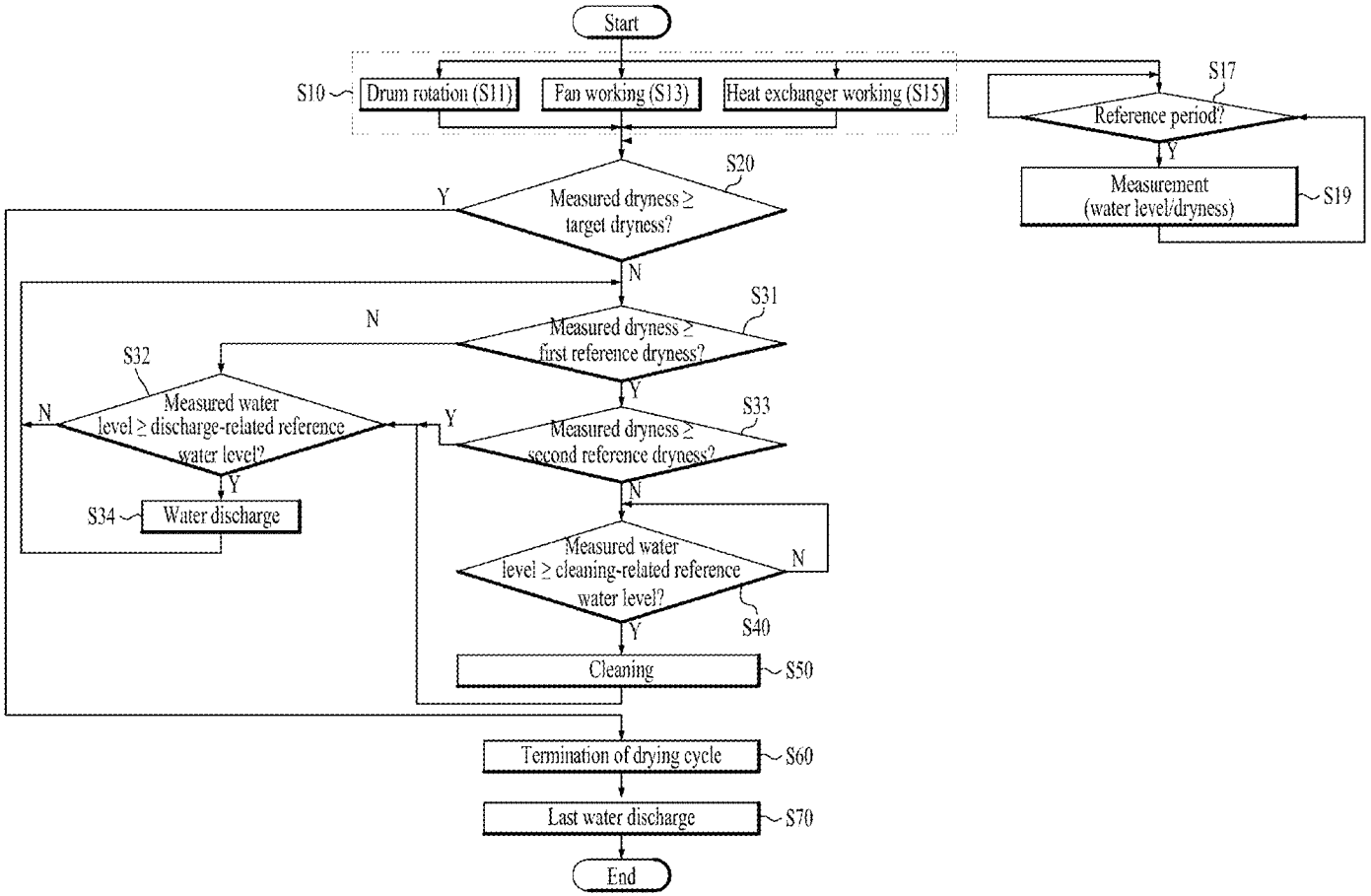

FIG. 6 shows a method for controlling a laundry treating apparatus capable of minimizing a problem that the filter assembly, the heat-absorber, and the contaminants remaining in the filter assembly are wet with water, using the above features.

A method control of FIG. 6 may include a drying operation S10, and measurement operations S17 and S19 that are periodically executed during the drying operation. The drying operation S10 may be configured to include an operation S11 of rotating the drum body 21 using the motor 23, an operation S13 of activating the fan 49 to circulate air inside the drum body, and an operation S15 of activating the heat exchanger 4.

The operation S13 of activating the fan may refer to a process in which the controller rotates the impeller 491 using the impeller motor 493. The operation S15 of activating the heat exchanger 4 may refer to a process in which the controller operates the compressor 45 and the pressure adjuster 47 to heat exchange between the air introduced into the duct and the refrigerant.

The measurement operation S19 may be carried out when a predefined reference period S17 has elapsed after the initiation of the drying operation S10. The measurement operation S19 may be configured to include a water-level measurement operation of measuring the water-level inside the water collector body 371 using the water collector water-level sensor 91, a dryness measurement operation of measuring the dryness of laundry using the dryness sensor, and a temperature measurement operation of measuring the temperature of air discharged from the drum body 21 using the temperature sensor 96. The dryness measurement operation may be configured to determine the dryness of laundry using at least one of the electrode sensor or the humidity sensor.

When the dryness of laundry measured in the measurement operation S19 is greater than or equal to a predefined target dryness, the control method proceeds with a termination operation S60 of terminating the drying operation, a water discharge operation S70 of transferring the water stored in the water collector body 371 to the water storage body 72, and a last water discharge operation S70.

The termination operation S60 may be configured to include an operation of controlling the motor 23 to terminate the rotation of the drum, an operation of controlling the impeller motor 493 to terminate the rotation of the impeller, and an operation of terminating the operation of the compressor 45 and the pressure adjuster 47.

The last water discharge operation S70 may refer to a process of controlling the pump 61 and the channel switch 63 to move water from the water collector body 371 to the water storage body 72. The water-level measurement operation belonging to the measurement operation S19 is preferably configured to be terminated upon completion of the last water discharge operation S70.

In one example, when the dryness measured in the measurement operation S19 is lower than the target dryness S20, the control method proceeds with an operation S31 of determining whether the dryness measured in the measurement operation S19 is higher than or equal to a predefined first reference dryness.

When the dryness measured in the measurement operation S19 is lower than the first reference dryness in the determination operation S31, the control method determines whether the water-level of the water collector body 371 measured in the measurement operation S19 is greater than or equal to a predefined discharge reference water-level S32. When the water-level of the water collector body 371 is greater than or equal to the discharge reference water-level, the control method proceeds with the water discharge operation S34. The water discharge operation S34 may refer to a process of controlling the pump 61 and the channel switch 63 to move the water from the water collector body 371 to the water storage body 72, and thus to prevent the water from the water collector body 371 from flowing into the duct 3.

When it is determined that the dryness measured in the measurement operation S19 is higher than or equal to the first reference dryness S31, the control method determines whether the dryness measured in the measurement operation S19 is greater than or equal to a predefined second reference dryness S33.

When the dryness measured in the measurement operation S19 is lower than the second reference dryness, the control method performs a cleaning operation S50 based on the water-level of water stored in the water collector body 371. That is, when the dryness measured in the measurement operation S19 is determined as a value between the first reference dryness and the second reference dryness S33, the control method determines whether the water-level of the water collector body 371 measured in the measurement operation S19 is greater than or equal to a predefined cleaning-related reference water-level S40. Then, when the water-level of the water collector body 371 is higher than or equal to the cleaning-related reference water-level, the control method proceeds with the cleaning operation S50.

The cleaning operation S50 may refer to a process of supplying water stored in the water collector body 371 to the water ejector 65 to clean the first filter assembly 5. Depending on a structure of the water ejector 65, the cleaning operation S50 may act as a process of cleaning the first filter assembly 5 and the heat-absorber 41, as a process of cleaning only the heat-absorber 41. The cleaning-related reference water-level may be set to the same water-level as the discharge reference water-level or may be set to a water-level lower than the discharge reference water-level.

To the contrary, when the dryness measured in the measurement operation S19 is greater than or equal to the second reference dryness, the control method proceeds with a water-level comparison operation S32 and the water discharge operation S34 as described above. That is, when the dryness measured in the measurement operation S19 is higher than or equal to the second reference dryness and is lower than the target dryness, the control method does not execute the cleaning operation S50. Thus, the first filter assembly 5, the heat-absorber 41, and the contaminants remaining in first filter assembly may be dried by performing the drying operation S10 without the cleaning operation S50.

The first reference dryness may refer to a reference used to determine a cleaning timing of the first filter assembly 5. The second reference dryness may refer to a reference used to determine the drying timing of the first filter assembly 5 and the heat exchanger 4.

That is, the first reference dryness may be set to a dryness used to determine whether the drying operation S10 has reached the first period from the time point A to the time point B shown in FIG. 5. The second reference dryness may be set to a dryness used to determines whether the drying operation S10 has reached the second period from the time point B to the time point C.

The first reference dryness may be set to a dryness equivalent to 30% to 35% of the target dryness or may set to a dryness at which a rate of temperature increase per minute of air discharged from the drum body 21 is lower than 0.1 degrees Celsius per minute.

In one example, the second reference dryness may be set to a dryness at which the temperature increase rate per minute of air discharged from the drum body 21 is 0.1 degrees Celsius to 0.2 degrees Celsius or greater per minute. Alternatively, the second reference dryness may be set to a dryness of 42% to 46% or greater of the target dryness, or may be set to a dryness at which the temperature increase rate per minute of air discharged from the drum body 21 is 0.1° C. to 0.2° C. or greater per minute.

In the above case, for the first period for which laundry and heat exchange are actively conducted during the drying operation S10, the control method may clean the first filter assembly 5 and the heat-absorber 41 based on the water-level of the water collector body 371. For the second period connected to the termination operation S60, even when the water-level of the water collector body 371 is higher than or equal to the cleaning-related reference water-level, the control method may not clean the first filter assembly 5 and the heat-absorber 41. Therefore, the control method may minimize the increase in the drying duration, while minimizing an amount of water remaining in the first filter assembly 5, and the heat-absorber 41, and water in remaining in the contaminants in first filter assembly 5.

The laundry treating apparatus and the method for controlling the laundry treating apparatus as above-described may be modified and implemented in various forms, and the scope of the disclosure is not limited to the above-described embodiments.

The invention claimed is:

1. A method for controlling a laundry treating apparatus, wherein the laundry treating apparatus comprises: a drum having a laundry storage space defined therein; a duct defining a channel for supplying air discharged from the drum back to the drum; a fan to move air along the duct; a heat-absorber for removing moisture from air introduced into the duct;

a heat-emitter disposed inside the duct to heat air passing through the heat-absorber; a water collector for storing therein water discharged from air passing through the heat-absorber; a filter assembly including a first filter to filter fluid moving to the heat-absorber and a second filter fixed to the first filter to filter fluid moving to the water collector; a water discharger having a water storage space defined therein; a water discharger supply pipe for supplying water stored in the water collector to the water discharger; a water ejector configured to eject water into the first filter; and a water ejector supply pipe for supplying water stored in the water collector to the water ejector; wherein the method comprises:

performing a drying operation in which the fan, the heat-absorber, and the heat-emitter conduct heat exchange between air and laundry inside the drum, wherein the drying operation is executed until a dryness of laundry reaches a predefined target dryness;

performing a dryness measurement operation in which the dryness of laundry is measured using at least one of an electrode sensor or a humidity sensor during the drying operation, wherein the humidity sensor is configured to measure a humidity of air flowing from the drum to the duct, and the electrode sensor is configured to contact the laundry and measure an amount of moisture contained in the laundry; and based on the dryness of the laundry being higher than a first reference dryness and lower than a second reference dryness, performing a cleaning operation in which water is supplied from the water collector to the water ejector to clean at least one of the filter assembly or the heat-absorber, wherein the second reference dryness is lower than the target dryness and higher than the first reference dryness, wherein the cleaning operation is not performed based on the dryness of the laundry being greater than or equal to the second reference dryness and less than the target dryness.

2. The method of claim 1, wherein the method further comprises a water-level measurement operation in which a water collector water-level sensor measures a water-level inside the water collector during the drying operation, wherein the cleaning operation is initiated when the water-level inside the water collector is higher than or equal to a predefined cleaning-related reference water-level.

3. The method of claim 2, wherein the method further comprises a water discharge operation in which when the dryness of laundry is higher than or equal to the second reference dryness, and the water-level inside the water collector is greater than or equal to a discharge reference water-level higher than or equal to the cleaning-related reference water-level, water flows from the water collector to the water discharger.

4. The method of claim 2, wherein the method further comprises a water discharge operation in which when the dryness of laundry is lower than the first reference dryness, and the water-level inside the water collector is greater than or equal to a discharge reference water-level higher than or equal to the cleaning-related reference water-level, water flows from the water collector to the water discharger.

5. The method of claim 1, wherein the first reference dryness is set to a dryness equal to 30% to 35% of the target dryness.

6. The method of claim 1, wherein the method further comprises a temperature measurement operation in which a temperature of air discharged from the drum is measured using a temperature sensor for measuring a temperature of air introduced into the duct, during the drying operation, wherein the first reference dryness is set to a dryness at which a temperature increase rate per minute of air discharged from the drum is smaller than 0.1 degrees Celsius per minute, wherein the second reference dryness is set to a dryness at which a temperature increase rate per minute of air discharged from the drum is equal to or larger than 0.1 to 0.2 degrees Celsius per minute.

7. The method of claim 1, wherein the method further comprises a temperature measurement operation in which a temperature of air discharged from the drum is measured using a temperature sensor for measuring a temperature of air introduced into the duct, during the drying operation, wherein the second reference dryness is equal to or greater than 42% to 46% of the target dryness, and is set to a dryness at which a temperature increase rate per minute of air discharged from the drum is equal to or larger than 0.1 to 0.2 degrees Celsius per minute.

8. A laundry treating apparatus comprising:

a cabinet having a laundry inlet and a filter insertion hole defined in a front face thereof;

a drum rotatably disposed inside the cabinet and having a laundry storage space defined therein communicating with the laundry inlet;

a duct disposed inside the cabinet, wherein the duct defines a channel for supplying air discharged from the drum back to the drum;

a fan to move air along the duct;

a heat exchanger including a heat-absorber to remove moisture from air introduced into the duct and a heat-emitter disposed inside the duct to heat air passing through the heat-absorber;

a water collector constructed to communicate with the duct and to store therein water discharged from the air passing through the heat-absorber;

a filter assembly including:

a filter assembly body attachable to or detachable from the duct and constructed to be extended from or retractable into the cabinet through the filter insertion hole;

a first filter disposed in the filter assembly body to filter fluid moving to the heat- absorber; and a second filter disposed in the filter assembly body to filter fluid moving to the water collector, wherein the second filter is positioned below the first filter;

a water discharger detachably disposed in the cabinet and having a water storage space defined therein;

a water discharger supply pipe for supplying water stored in the water collector to the water discharger;

a water ejector configured to eject water into the first filter; and a water ejector supply pipe for supplying water stored in the water collector to the water ejector.

9. The apparatus of claim 8, wherein the second filter is disposed on a bottom face of the filter assembly body extending from a bottom of the first filter toward the filter insertion hole.

10. The apparatus of claim 8, wherein the apparatus further comprises:

a bypass hole defined in a face of the filter assembly body free of the first filter and the second filter, wherein the bypass hole communicates an inside of the filter assembly body with the water collector; and a third filter disposed in the bypass hole.

11. The apparatus of claim 10, wherein the first filter has an inclination of 90 degrees to 100 degrees from a bottom face of the filter assembly body toward a front face of the heat-absorber, wherein the second filter has an inclination of 10 degrees to 20 degrees upward from a bottom of the first filter toward the filter insertion hole, wherein the bypass hole is located at a level higher than a top level of the second filter and lower than a top level of the first filter.

12. The apparatus of claim 8, wherein the apparatus further comprises:

an insertion hole door rotatably disposed on the cabinet to open and close the filter insertion hole; and a control panel including at least one of a display for displaying a command selected by a user or an input interface for receiving a control command from the user, wherein the control panel is fixed to the insertion hole door.

13. The apparatus of claim 12, wherein the insertion hole door is disposed on a bottom of a front panel of the cabinet.

* * * * *